US010156018B2

(12) United States Patent
Joo et al.

(10) Patent No.: US 10,156,018 B2
(45) Date of Patent: Dec. 18, 2018

(54) METHOD FOR MANUFACTURING ANODIC METAL OXIDE NANOPOROUS TEMPLATES

(71) Applicant: Korea University Research and Business Foundation, Seoul (KR)

(72) Inventors: Jinsoo Joo, Seoul (KR); Young Ki Hong, Seongnam-si (KR)

(73) Assignee: Korea University Research and Business Foundation, Seoul (KR)

( * ) Notice: Subject to any disclaimer, the term of this patent is extended or adjusted under 35 U.S.C. 154(b) by 0 days.

(21) Appl. No.: 15/200,647

(22) Filed: Jul. 1, 2016

(65) Prior Publication Data

US 2017/0029969 A1 Feb. 2, 2017

(30) Foreign Application Priority Data

Jul. 2, 2015 (KR) ..... 10-2015-0094483

(51) Int. Cl.

*C25D 1/00* (2006.01)
*C25D 1/10* (2006.01)
*C25D 1/20* (2006.01)

(52) U.S. Cl.

CPC ..... *C25D 1/10* (2013.01); *C25D 1/006* (2013.01); *C25D 1/20* (2013.01)

(58) Field of Classification Search

CPC . C25D 1/10; C25D 1/006; C25D 1/20; C25D 11/18

See application file for complete search history.

(56) References Cited

U.S. PATENT DOCUMENTS

2008/0057293 A1* 3/2008 Hatanaka ..... B01J 23/42 428/319.1
2010/0258445 A1* 10/2010 Arurault ..... C25D 11/18 205/222
2014/0202868 A1* 7/2014 Afzulpurkar ..... C25D 11/045 205/50

FOREIGN PATENT DOCUMENTS

KR 102011013903 12/2011

OTHER PUBLICATIONS

Penetrating the Oxide Barrier in Situ and Separating Freestanding Porous Anodic Alumina Films in One StepMingliang Tian,*,et al, Nano Letters 2005 5 (4), 697-703, DOI: 10.1021/nl0501112.*

* cited by examiner

*Primary Examiner* — Louis J Rufo
(74) *Attorney, Agent, or Firm* — NSIP Law

(57) ABSTRACT

Disclosed is a method for manufacturing anodic metal-oxide nanoporous templates with high-yield and in an environmentally-friendly manner. The method includes anodizing a metal specimen and detaching nanoporous anodic oxide layers, which are formed on more than one surface of the metal specimen due to the anodizing, from the metal specimen, wherein the detaching of the nanoporous anodic oxide layers from the metal specimen includes applying a reverse bias to the metal specimen in the same acidic electrolyte used for anodization.

10 Claims, 12 Drawing Sheets

METHOD FOR MANUFACTURING ANODIC METAL OXIDE NANOPOROUS TEMPLATES

CROSS-REFERENCE TO RELATED APPLICATIONS

A claim for priority under 35 U.S.C. § 119 is made to Korean Patent Application No. 10-2015-0094483 filed Jul. 2, 2015, in the Korean Intellectual Property Office. The entire contents of this application are hereby incorporated by reference.

BACKGROUND

Embodiments of the inventive concepts described herein relate to a method for manufacturing anodic metal-oxide nanoporous templates, and more particularly, relate to a method for manufacturing anodic metal-oxide nanoporous templates through a highly efficient and eco-friendly process.

When an electric field is applied to a metal in an acidic electrolyte, a nanoporous anodic oxide layer is formed on the surface of the metal. Such phenomena are defined as anodization.

FIG. 1 illustrates a nanoporous anodic oxide layer formed on the surface of a metal.

A nanoporous anodic oxide layer has a honeycomb structure in which hexagonal unit cells are periodically arranged as shown in FIG. 1. At the centers of the unit cells, nanopores are present with relatively large aspect rations.

Anodization is traditional technology of forming a protection layer for preventing a metallic surface from corrosion. In recent years, many studies are sprightly progressing for applications to biotechnology, energy storage, filters, and nanoporous templates for fabricating functional nanostructures.

For these applications, an anodic metal oxide, in which nanopores are uniformly arranged over a large area, should be needed. And addition procedures, such as detaching a fabricated anodic oxide layer from a metal substrate and removing a barrier oxide layer to open both sides of the nanopores, would be required.

The 2-step anodization reported by H. Masuda et al. is that a mild anodizing process is repeated twice, resulting in a nanoporous anodic aluminum oxide (AAO) layer with superior periodicity over a relatively large area.

For example of fabrication, after texturing an aluminum surface by removing an AAO, which is formed by a pre-anodizing process, through a main etching, a main anodizing process may be further executed to periodically concentrate an electric field by anodic bias.

As a result, nanopores with a uniform diameter are formed in centers of hexagonal unit cells. An electro-polishing process for reducing surface roughness of aluminum contributes to shortening a time for texturing. The most general method of detaching such an AAO from a remaining aluminum is to dissolve the remaining aluminum in a solution of mercury chloride ($HgCl_2$) or copper chloride. Before chemical dissolution of the remaining aluminum substrate, a process of coating an upper part of the AAO (the opposite side of a barrier oxide) with an organic material might be needed to prevent an aluminum-removing reagent from infiltrating into nanopores. Then, a process of removing an oxide layer barrier or widening nanopores is optionally performed to adjust a detached AAO for the application.

The conventional technology consisting of AAO fabricating and separating procedure has a couple of drawbacks, which are time-consuming procedure, utilizing a reagent poisonous to human bodies and environments, and inefficient usage of resources.

In a view point of a fabricating time, conventional technology generally adopts mild anodizing scheme exhibiting relatively slow AAO growth rate, which has to repeat twice in 2-step anodization method. In addition, dissolving time for separating AAO should be considered, which is proportional to a thickness of remaining aluminum.

A hard anodizing (HA) process, proposed to overcome such a problem, is useful to greatly improve the growth rate and uniformity of an AAO, but it is necessary to prepare an expensive cooling device for dissipating heat generation due to a high anodic current. Furthermore, nanopore diameter in AAO fabricated from HA process is relatively small comparing with that from MA, which is restrictive to its potential applications.

Moreover, $HgCl_2$ used in the AAO separation is highly toxic to human bodies and environments. In the case of using a thin specimen for reducing a dissolving time determined by a thickness of aluminum, it is difficult to handle the specimen during whole procedure.

Although recent reports about directly detaching an AAO from aluminum using pulse-type anodic bias, these technologies are inevitable to use highly reactive and dangerous reagents such as butanedione or perchloric acid based detaching electrolytes. Additionally, because an anodic electrolyte is different from a detaching electrolyte, more solid washing/cleaning step should be added thereto to increase the complexity of process.

Furthermore, the conventional AAO detaching technology could not reuse the metal (e.g., aluminum) specimen because remaining part is wasted by dissolving it away.

Finally, the aforementioned conventional technologies can only produce one AAO through the full process because they are just applicable to a mono-surface of an aluminum specimen. And, in the case of using a polygonal specimen, it is necessary to apply a process or specimen holder for preventing other surfaces but a target surface from anodization.

SUMMARY

Embodiments of the inventive concepts provide a method for improving the efficiency of manufacturing anodic metal-oxide nanoporous templates, and provide a method for manufacturing anodic metal-oxide nanoporous templates without a pollutant which may be generated during a process of the method.

In an embodiment, a method for manufacturing anodic metal-oxide nanoporous templates may include simultaneous anodizing multi-surfaces on a metallic specimen, and simultaneous detaching nanoporous anodic oxide layers, which are formed on the metallic specimen due to the anodizing, from the metal specimen, wherein the detaching of the nanoporous anodic oxide layers from the metal specimen may include applying a reverse bias to the metal specimen.

In an embodiment, a method for manufacturing anodic metal-oxide nanoporous templates may include (a) preparing an aluminum specimen, (b) electro-polishing the multi-surfaces of the aluminum specimen in a electrolyte based on perchloric acid and ethanol, (c) pre-anodizing the electro-polished aluminum specimen in a sulfuric acid electrolyte by applying a anodic (forward) bias for anodization to the electro-polished aluminum specimen, (d) main-etching pre-anodized aluminum oxide layers (pre-AAOs), which are generated by the pre-anodizing, through a chromic acid aqueous solution, (e) main-anodizing the aluminum specimen to form main-anodized aluminum oxides (main-AAOs) by dipping more than one surface of the aluminum specimen, which are textured through the pre-anodizing and etching, in a sulfuric acid solution and by reapplying a same anodic bias for anodization to the textured aluminum specimen, and (f) applying a reverse bias to the aluminum specimen to detach main-anodized aluminum oxide layers, which are generated by the main-anodizing, from the aluminum specimen.

BRIEF DESCRIPTION OF THE FIGURES

The above and other objects and features will become apparent from the following description with reference to the following figures, wherein.

Throughout the figures, like reference numerals refer to like parts unless otherwise specified.

DETAILED DESCRIPTION

Embodiments will now be described in detail with reference to the accompanying figures. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques will not be described with respect to some of the embodiments of the inventive concept. In the figures, the sizes and relative sizes of layers and regions may be exaggerated for clarity.

Figure 1:
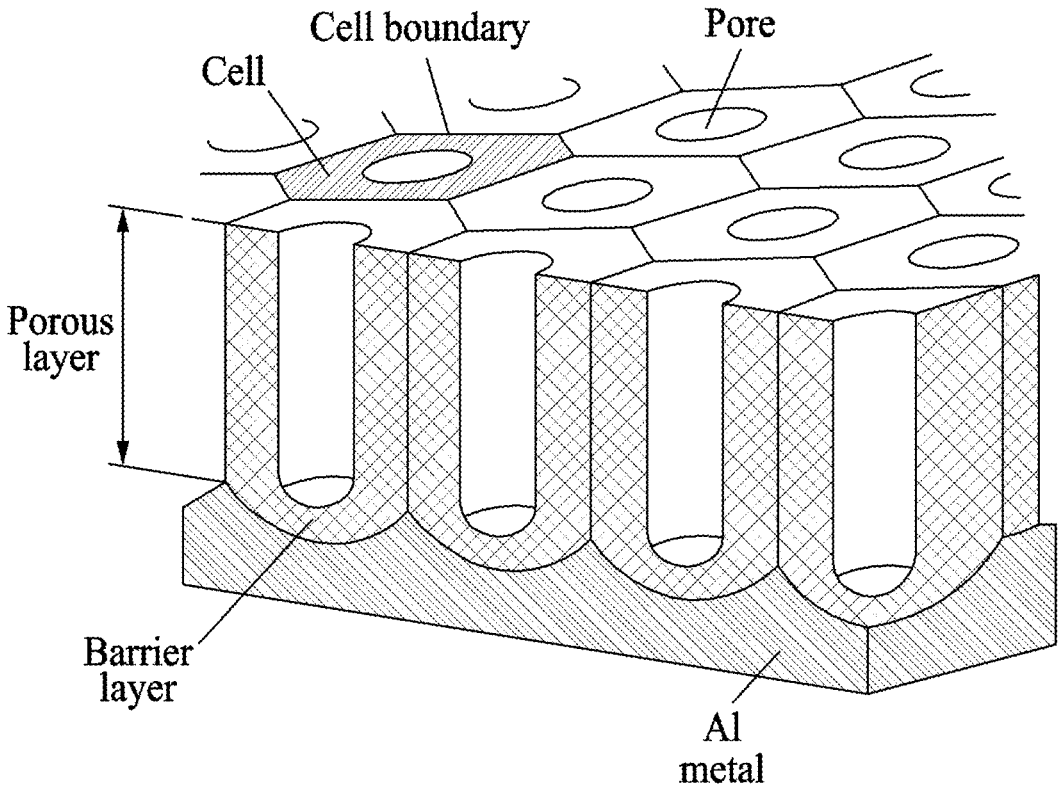
FIG. 1 illustrates a nanoporous anodic oxide layer formed on the surface of a metal.
Figure 2:
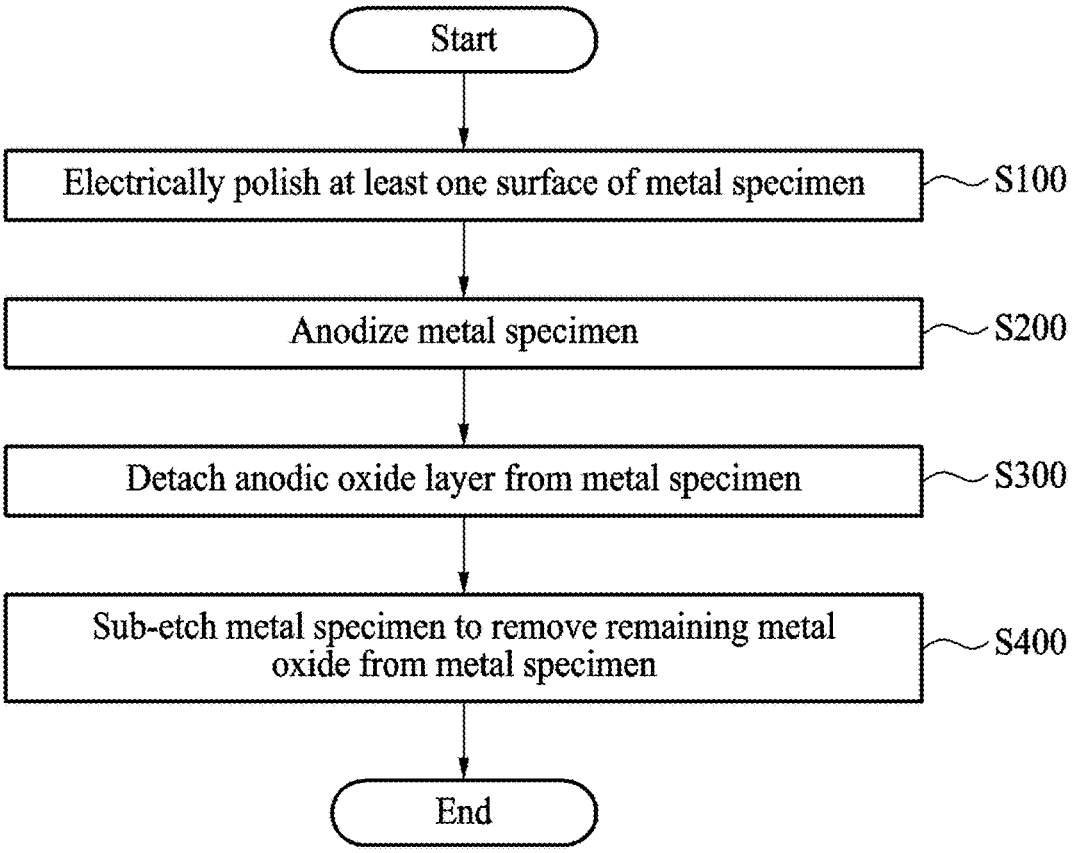
FIG. 2 is a flow chart showing a method for manufacturing anodic metal-oxide nanoporous templates according to embodiments of the inventive concept.

<First Embodiment> Method for Manufacturing Anodic Metal-Oxide Nanoporous Templates FIG. 2 is a flow chart showing a method for manufacturing anodic metal-oxide nanoporous templates according to embodiments of the inventive concept.

Figure 3:
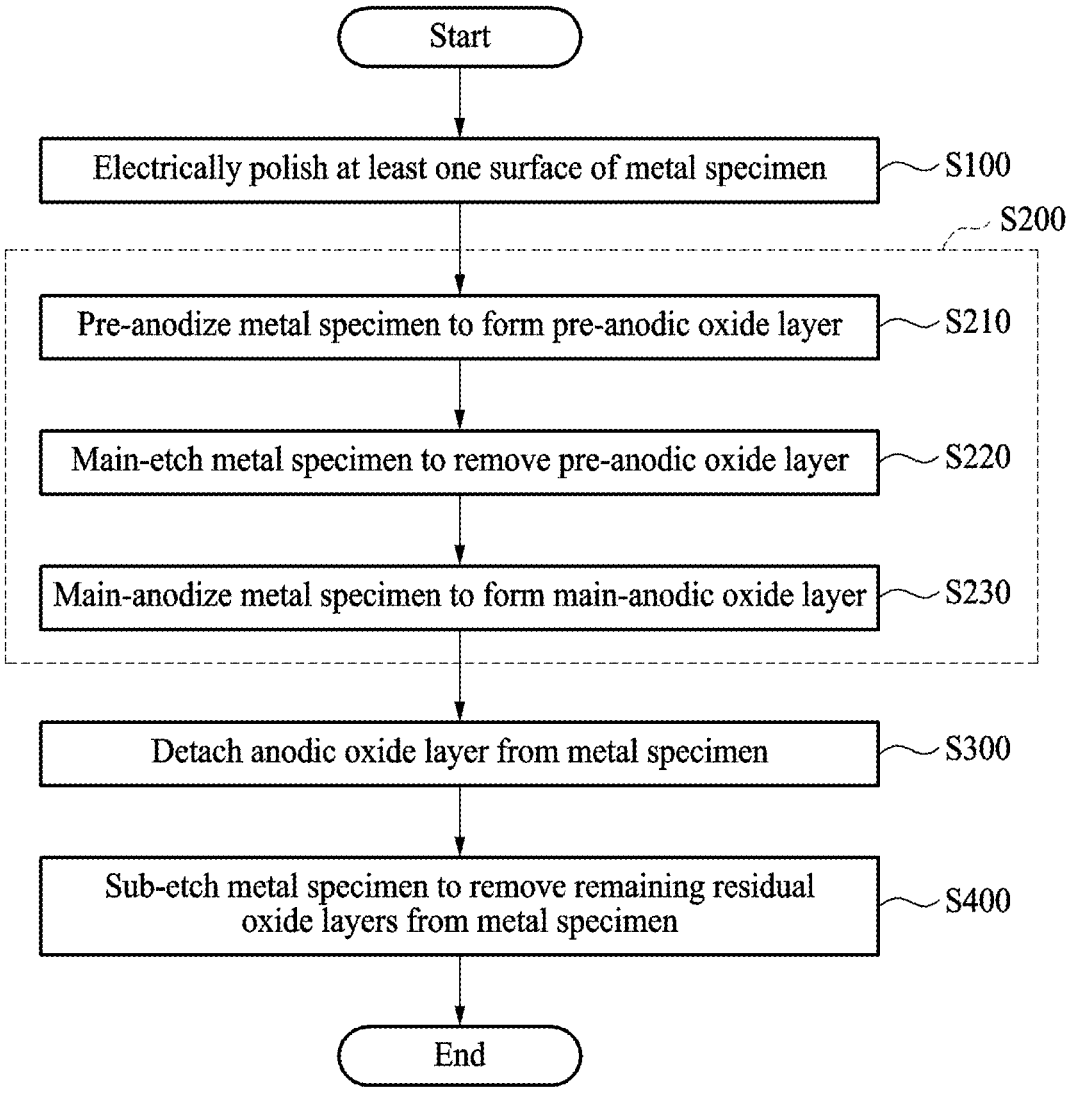
FIG. 3 is a detailed flow chart showing a method for manufacturing anodic metal-oxide nanoporous templates according to embodiments of the inventive concept.

FIG. 3 is a detailed flow chart showing a method for manufacturing anodic metal-oxide nanoporous templates according to embodiments of the inventive concept.

As shown in FIG. 2, a method for manufacturing anodic metal-oxide nanoporous templates according to embodiments of the inventive concept may include steps of electro-chemically polishing at least one of surfaces of a metal specimen (S100), anodizing the metal specimen (S200), and detaching anodic oxide layers, which are formed on the metal specimen due to the anodization, from the metal specimen (S300).

The step of electro-chemically polishing the metal specimen (S100) may allow formations of multiple anodic oxide layers by simultaneously electro-polishing multi-surfaces of the metal specimen, and may include an ultrasonicating step for removing organic residues from the metal surfaces.

In the step of anodizing the metal specimen (S200), nanoporous anodic oxide layers (anodic oxide surface film) may be formed on the multi-surfaces on the metal specimen by immersing metal specimen in an acidic electrolyte and then applying electric field (anodic bias) to the metal specimen, which was connected to an anode.

Referring to FIG. 3, the step of anodizing the metal specimen (S200) may include a pre-anodizing step (S210) on at least one of surfaces of the metal specimen by applying a anodic (forward) bias for anodization the metal specimen; a main-etching step (S220) removing pre-anodized oxide layers which are generated by the pre-anodizing; and a main-anodizing step (S230) forming main-anodized oxide layers on more than one surface of the textured metal specimen through the pre-anodizing and etching by reapplying a same anodic (forward) bias.

The pre-anodizing step (S210) may texture at least one surface of the metal specimen. Through the pre-anodizing step (S210), pre-anodized oxide layers, which are relatively less-arranged, may be formed on the surfaces of the metal specimen. The pre-anodized oxide layers may be removed from the surfaces of the metal specimen through the main-etching step.

After removing the pre-anodized oxide layers through the main-etching step (S220) as a main etching process, textured surfaces were obtained. Then, anodization may be resumed to periodically concentrate an electric field by an anodic bias and to form nanopores in a uniform diameter.

Through the main-anodizing step (S230) to reapply a forward bias for anodizing the metal specimen which is textured by the main-etching step (S220), main-anodized oxide layers may be formed with nanopores with enhanced uniformity.

Pre-anodized oxide layers generated through the pre-anodizing step S210 to all surfaces or at least one or more surfaces of the metal specimen in an acidic electrolyte, and main-anodized oxide layers generated through the main-anodizing step S230 may be formed on at least one or more surfaces of the metal specimen.

An acidic electrolyte may be a sulfuric acid aqueous solution. Acidic electrolyte used in the pre-anodizing step S210 and the main-anodizing step S230 may be the same solution, but embodiments of the inventive concept may not be restrictive hereto.

As shown in FIG. 3, after the step S200 of anodizing the metal specimen, the step S200 including the pre-anodizing step S210, the main-etching step S220 for pre-AAOs, and the main-anodizing step S230, the procedure goes to a step S300 of detaching main-anodized oxide layers, which are formed on the surfaces of the metal specimen through the main-anodizing step S230, from the metal specimen.

At the step S300 of detaching the main-anodized oxide layers from the metal specimen, a reverse bias can be applied to the metal specimen. The reverse bias applied to the metal specimen may be a stair-like reverse bias. In the case of increasing the reverse bias stair-likely, air bubbles may begin to be generated at the multi-interfaces between the main-anodized oxide layers and the corresponding surfaces on the metal specimen, thereby inducing a current therein to detach the main-anodized oxide layers from the metal specimen.

The step S300 of detaching the main-anodized oxide layers from the metal specimen may use the same with the acidic electrolyte which has been used in the pre-anodizing step S210 and the main-anodizing step S230, but embodiments of the inventive concept may not be restrictive hereto.

The detached main-AAOs later may be washed several times through acetone, ethanol, and de-ionized (DI) water.

Additionally, after detaching the main-anodized oxide layers from the metal specimen, a main-etching step S400 may be performed to remove a remaining residual oxide layers from the metal specimen. This is a step for recycling the metal specimen, in which the remaining oxide may be removed through the same manner with the main-etching step S220.

Figure 4:
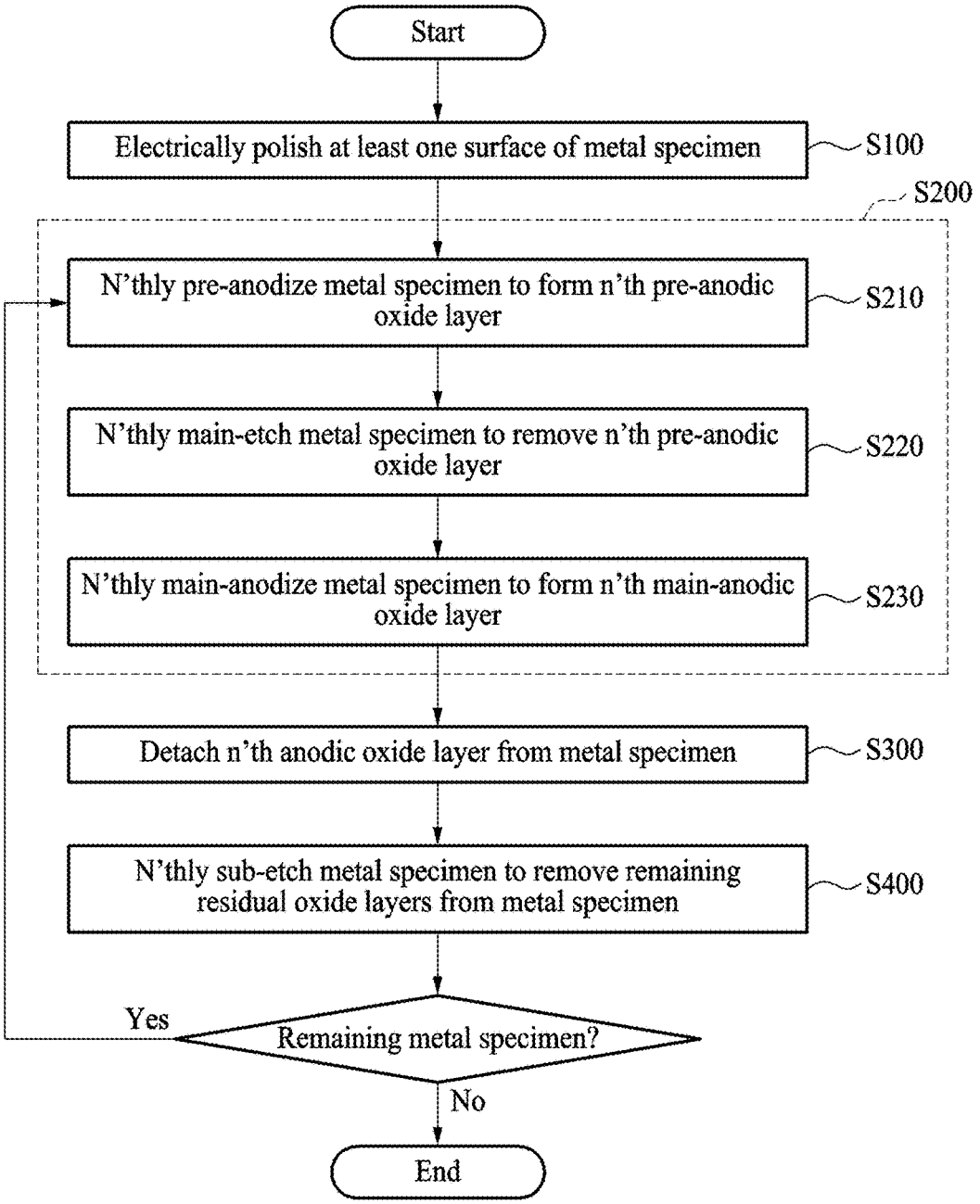
FIG. 4 is a flow chart showing a process of manufacturing anodic metal-oxide nanoporous templates through repetition of a method for manufacturing nanoporous templates according to embodiments of the inventive concept.

FIG. 4 is a flow chart showing a process of manufacturing anodic metal-oxide nanoporous templates through repetition of a method for manufacturing nanoporous templates according to embodiments of the inventive concept.

As shown in FIG. 4, in the case that there is still a further remaining a metal specimen even after removing remaining oxides from the metal specimen, main-anodized oxide layers, i.e., nanoporous templates, may be massively produced by sequentially repeating two or more times procedures from S210 to S300 (S400).

<Second Embodiment> Method for Manufacturing Aluminum-Oxide Nanoporous Templates Now a process of manufacturing anodic aluminum oxide (AAO) nanoporous templates, for which an aluminum metal is used with a method of manufacturing anodic metal-oxide nanoporous templates according to embodiments of the inventive concept, will be described below.

Numerical values mentioned herein are merely examples for practically describing a second embodiment of the inventive concept, but embodiments of the inventive concept may not be restrictive hereto.

Figure 5:
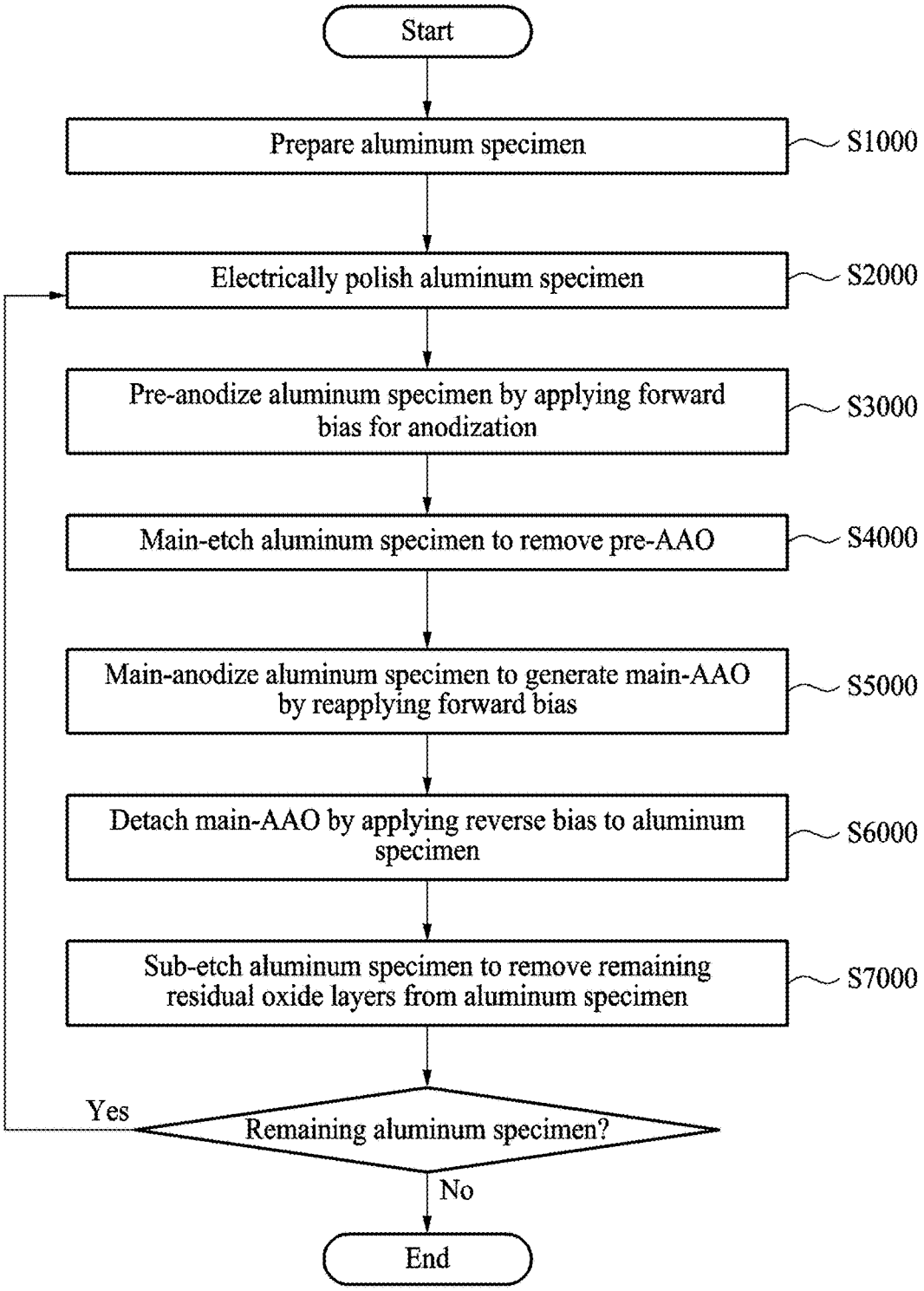
FIG. 5 is a flow chart showing a process of manufacturing anodic metal-oxide nanoporous templates using an aluminum specimen according to embodiments of the inventive concept.

FIG. 5 is a flow chart showing a process of manufacturing anodic metal-oxide nanoporous templates using an aluminum specimen according to embodiments of the inventive concept.

A method for manufacturing anodic metal-oxide nanoporous templates using an aluminum specimen may include steps of preparing an aluminum specimen (S1000), electro-polishing the surfaces of the aluminum specimen in an electrolyte based on perchloric acid and ethanol (S2000); pre-anodizing the electro-polished aluminum specimen by applying a anodic (forward) bias for anodization (S3000); main-etching pre-anodized aluminum oxide (pre-AAO) layers, which are generated by the pre-anodizing, through a chromic acid aqueous solution (S4000); main-anodizing the more than one surface of aluminum specimen to form main-anodized aluminum oxide (main-AAO) layers in a sulfuric acid electrolyte by reapplying a same anodic (forward) bias for anodization to the textured aluminum specimen (S5000); and applying a reverse bias to the aluminum specimen to detach the main-AAO layers, which are generated by the main-anodizing, from the aluminum specimen (S6000).

Additionally, the method for manufacturing anodic metal-oxide nanoporous templates using an aluminum specimen may further include a main-etching step S7000 for removing a residual oxide layers from the aluminum specimen.

Experimental Example

Apparatus for manufacturing nanoporous AAO templates consists of a double-jacket beaker, a magnetic stirrer, a power supply and a low-temperature bath-circulator. The double-jacket beaker installed on the magnetic stirrer was connected with the low-temperature bath-circulator to maintain electrolyte temperature throughout the experiment. DI water and ethanol (95%) mixed in the ratio 1:1 was used as circulating medium.

Figure 6:
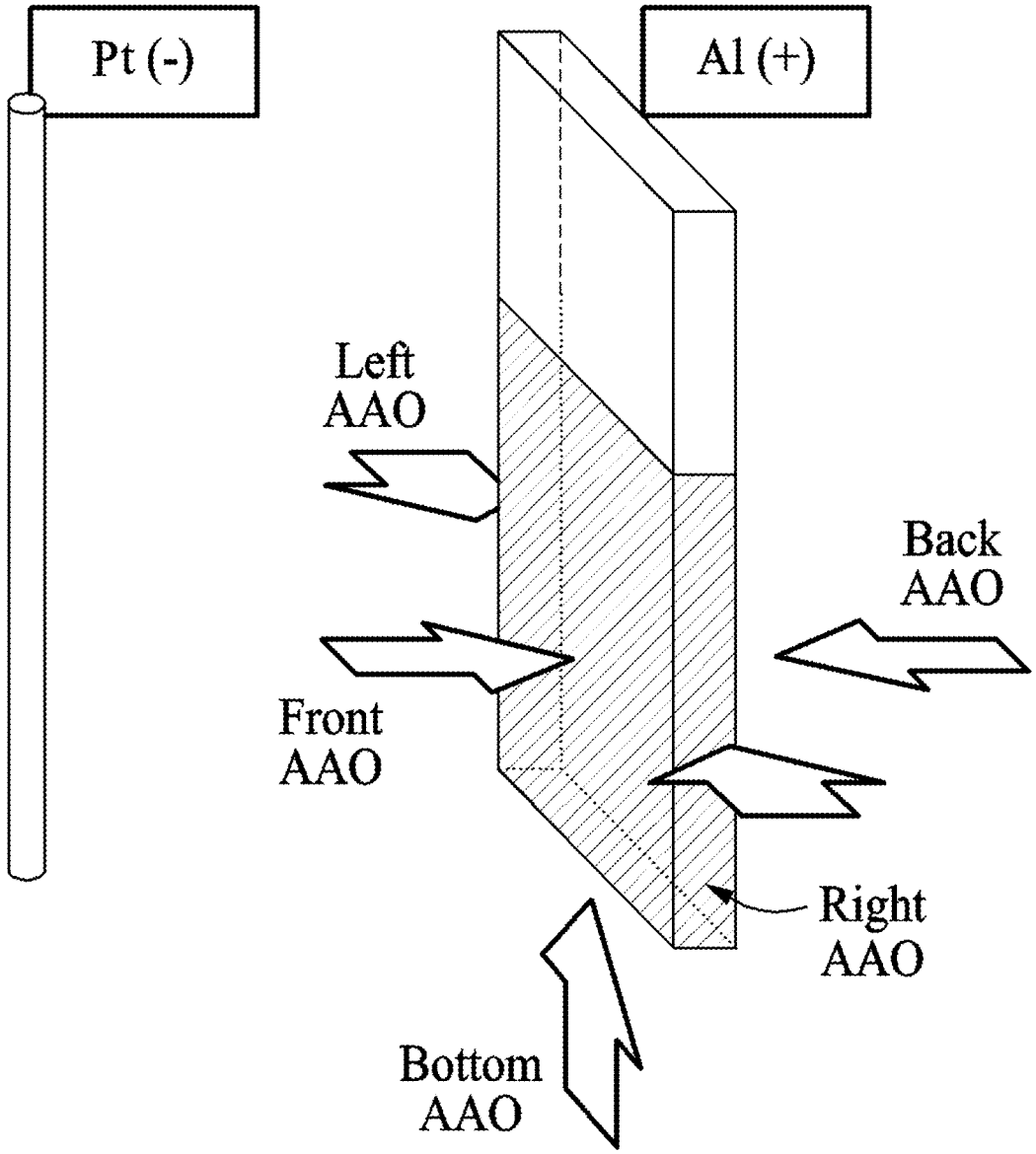
FIG. 6 is a schematic diagram illustrating arrangements of electrode and specimen for manufacturing anodic metal-oxide nanoporous templates. Simultaneously anodized multi-surfaces are depicted using blue color.

FIG. 6 shows a schematic diagram for arranging electrode and aluminum specimen for manufacturing AAO templates.

Figure 7A:
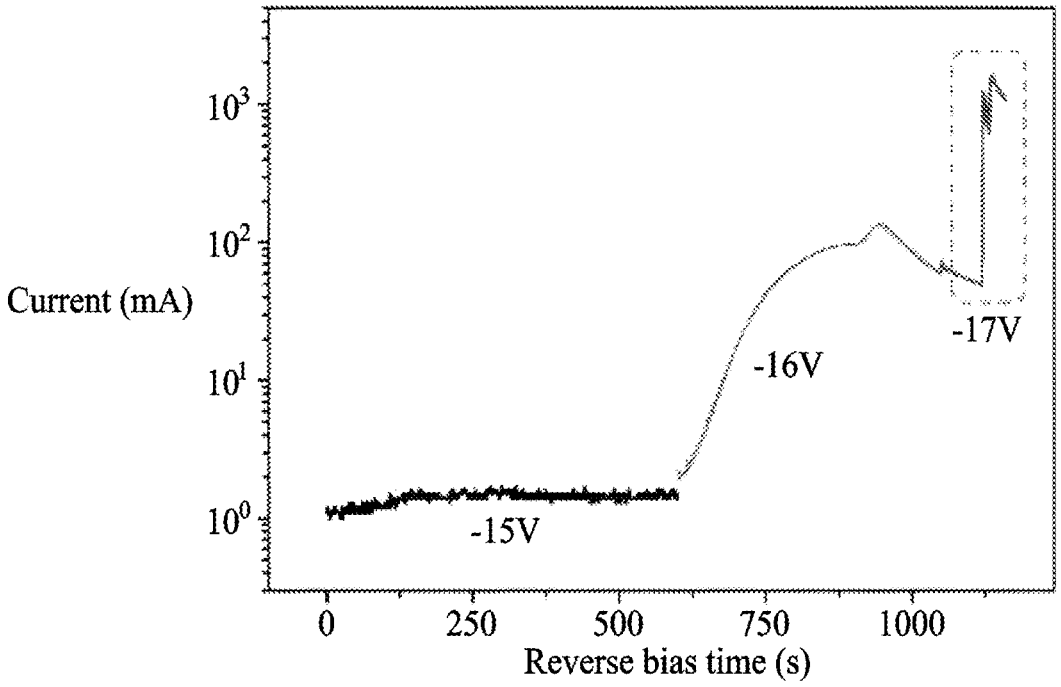
FIG. 7A shows current-time characteristic curve during the detachment of AAOs from aluminum substrate by applying stair-like reverse bias.
Figure 7B:
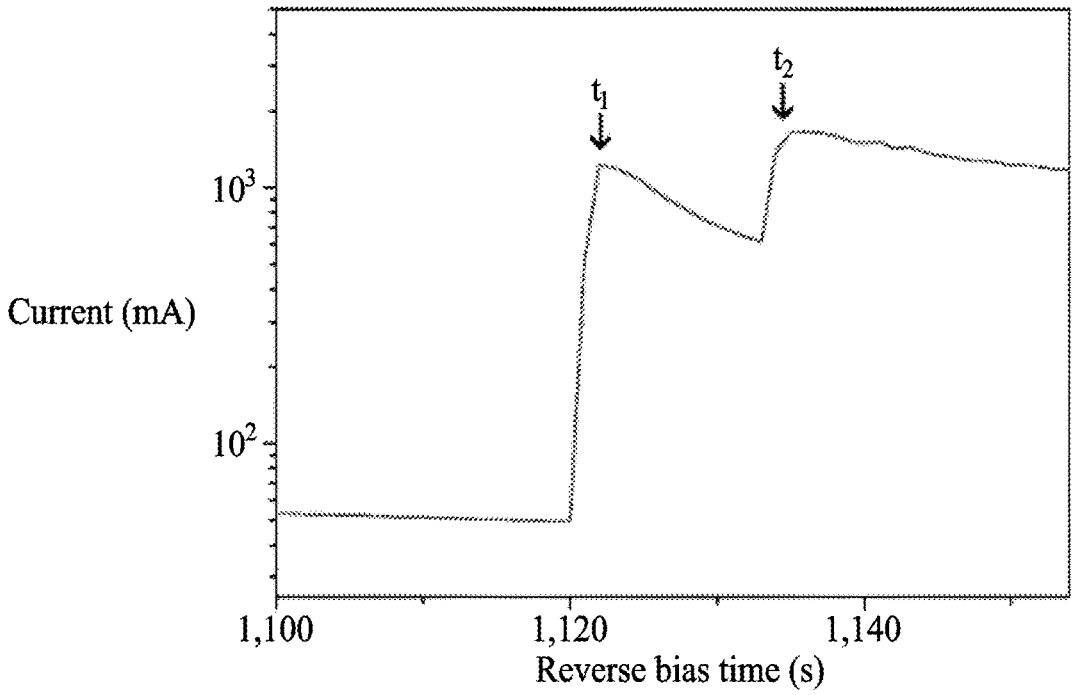
FIG. 7B is magnification of brown-dashed box in FIG. 7A.

FIG. 7A shows current-time characteristic curve during the detachment of AAOs from aluminum specimen by applying stair-like reverse bias. FIG. 7B is magnification of brown-dashed box in FIG. 7A;

As shown in FIG. 6, cylindrical platinum (Pt; 50.0 mm in length and 1.0 mm in diameter) was used for a counter electrode, a forward bias was applied to an aluminum specimen during electro-chemical polishing and anodization, and a reverse bias was applied to the aluminum specimen in detaching anodic oxide layers from the aluminum specimen.

At a step S1000 of preparing aluminum specimen, more than 99.99% purified aluminum specimen was cut into a rectangular parallelepiped with right angled edges, which was ultrasonicated for 30 minutes in an acetone solution, and then washed several times by DI water.

At a step S2000 of electro-polishing the surfaces of the aluminum specimen in an electrolyte based on perchloric acid and ethanol, multiple surfaces of the aluminum specimen were simultaneously electro-polished to reduce the surface roughness. An electrolyte was made by mixing perchloric acid (60%) and an ethanol solution in the volume ratio 1:4 and a forward bias of +20 V was applied less than 5 minutes. During electro-polishing, temperature of the electrolyte was maintained at 7° C. The electro-polished aluminum specimen was washed using ethanol (95%) and DI water.

At a pre-anodizing step S3000 for fabricating pre-AAOs, the electro-polished aluminum specimen was immersed in a sulfuric acid electrolyte of 0.3 M, a anodic (forward) bias of +25 V was applied thereto, and an acidic electrolyte was magnetically stirred (800-1000 rpm) to maintain temperature at 0° C. during the pre-anodizing step.

At a main-etching step S4000 for removing pre-AAOs, which were generated from the pre-anodizing step S3000, the pre-AAOs formed on the multiple surfaces of the aluminum specimen were removed using a chromic acid aqueous solution at 60° C. Through this process, the surfaces of the aluminum specimen may be textured in the same time.

At a main-anodizing step S5000 to more than one surface of the aluminum specimen textured through the pre-anodizing S3000 and main-etching step S4000, the forward bias of +25 V was applied to the aluminum specimen in a sulfuric acid electrolyte (0.3 M) in the same condition with the pre-anodizing step S3000.

At a step S6000 of applying reverse bias to the aluminum specimen for detaching main-AAOs from the aluminum specimen, relatively small current is monitored at the initial stage of detaching procedure when a reverse voltage of −15 V is applied to the aluminum specimen. This is because all surfaces of the aluminum specimen are covered with the main-AAOs and cracks in multiple edges do not reach the surface of the aluminum specimen. Hereupon, if a reverse bias of −16 V is reapplied thereto, air bubbles begins to be generated, and current increased toward the maximum.

As shown in FIG. 7B, abrupt enhancements of current are observed two times (1,230 and 1,650 seconds) when a reverse bias is increased up to −17 V. These are time points when the main-AAOs are detached from the front and the back surface of the aluminum specimen, respectively. During this procedure, an acidic electrolyte is infiltrated into the multiple interfaces between the aluminum specimen and the main-AAOs, and then the stresses accumulated between the interfaces are released to accelerate the detachment.

Figure 8A:
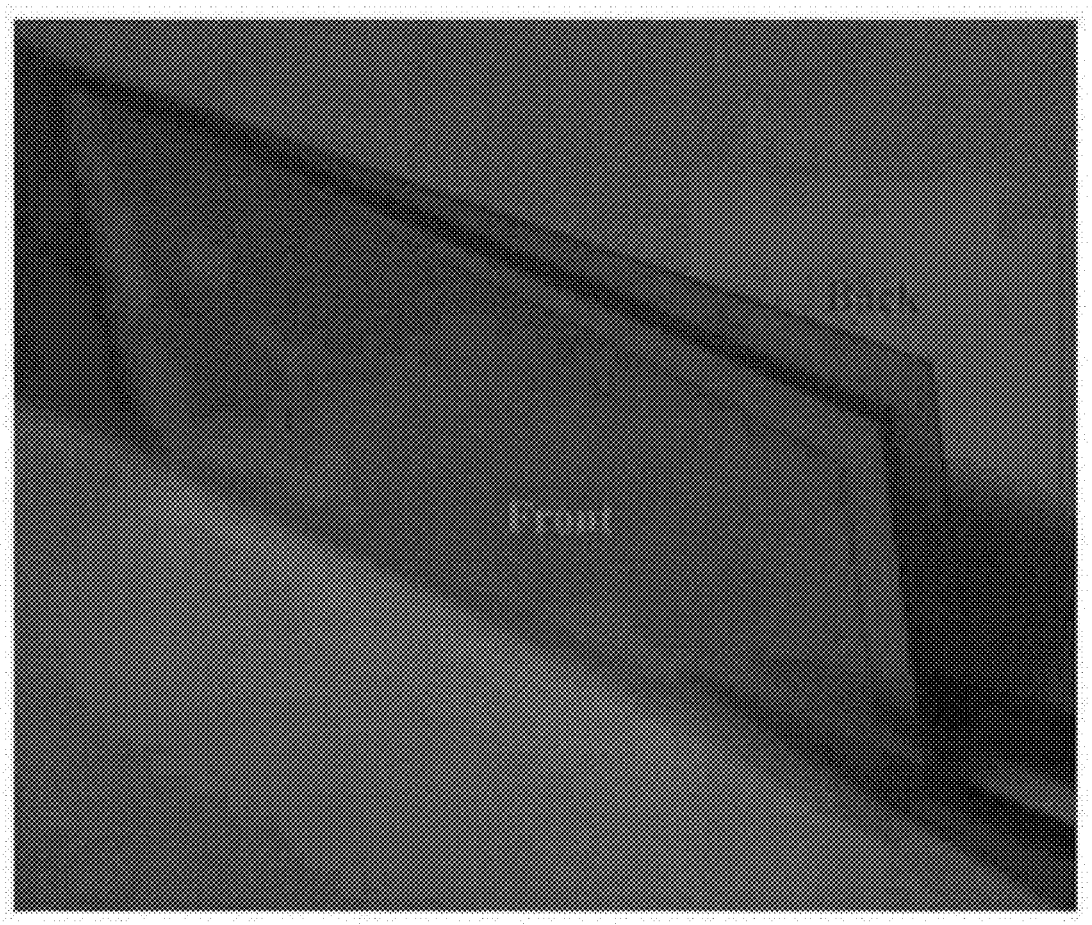
FIG. 8A shows a photograph of as-detached main-AAOs.
Figure 8B:
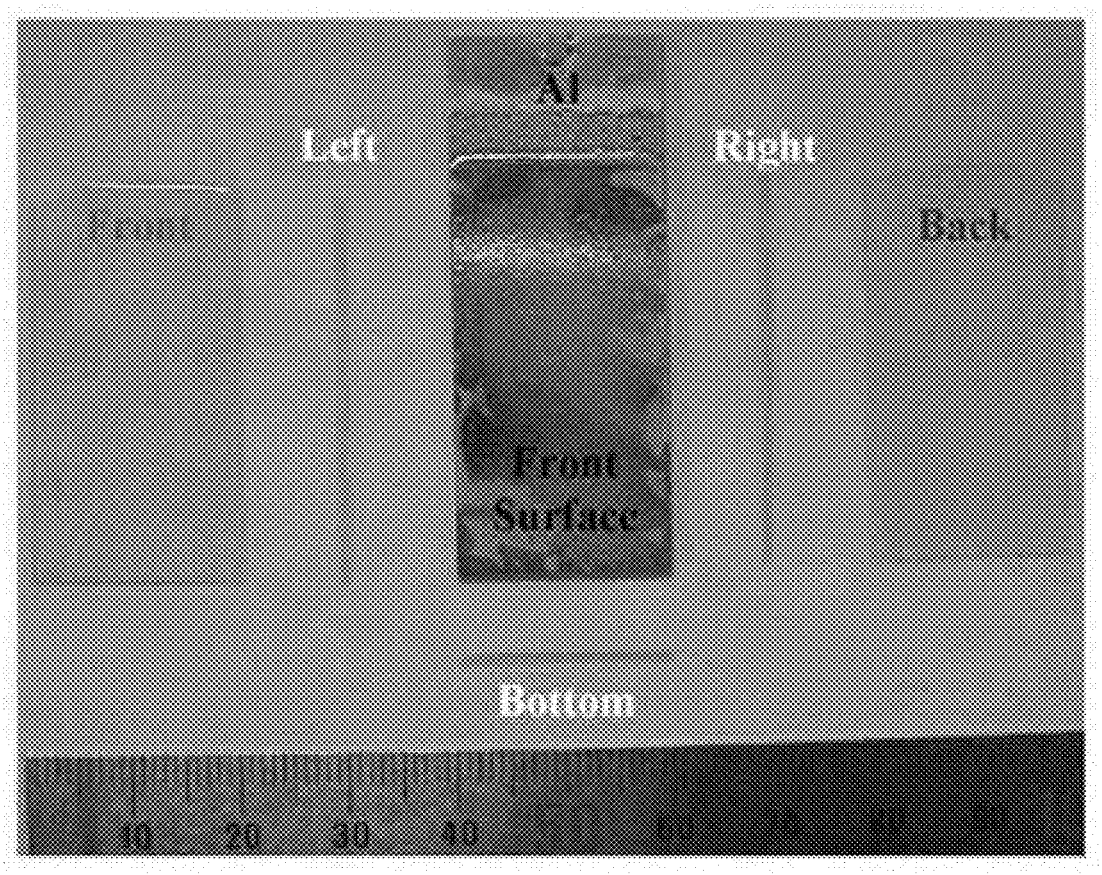
FIG. 8B shows a photograph of the remaining aluminum specimen and five detached AAOs, which have equal dimensions of corresponding multi-surfaces of the aluminum specimen.

FIGS. 8A and 8B show photographs of the detached nanoporous main-AAOs and remaining aluminum specimen.

As shown in FIG. 8, the detached main-AAOs have very equal dimensions comparing with those of corresponding surfaces on the aluminum specimen.

At a sub-etching step S7000 for removing a residual oxide layers, the remaining aluminum specimen is treated in the same condition with the main-etching step S4000 for about 30 minutes.

Figure 9:
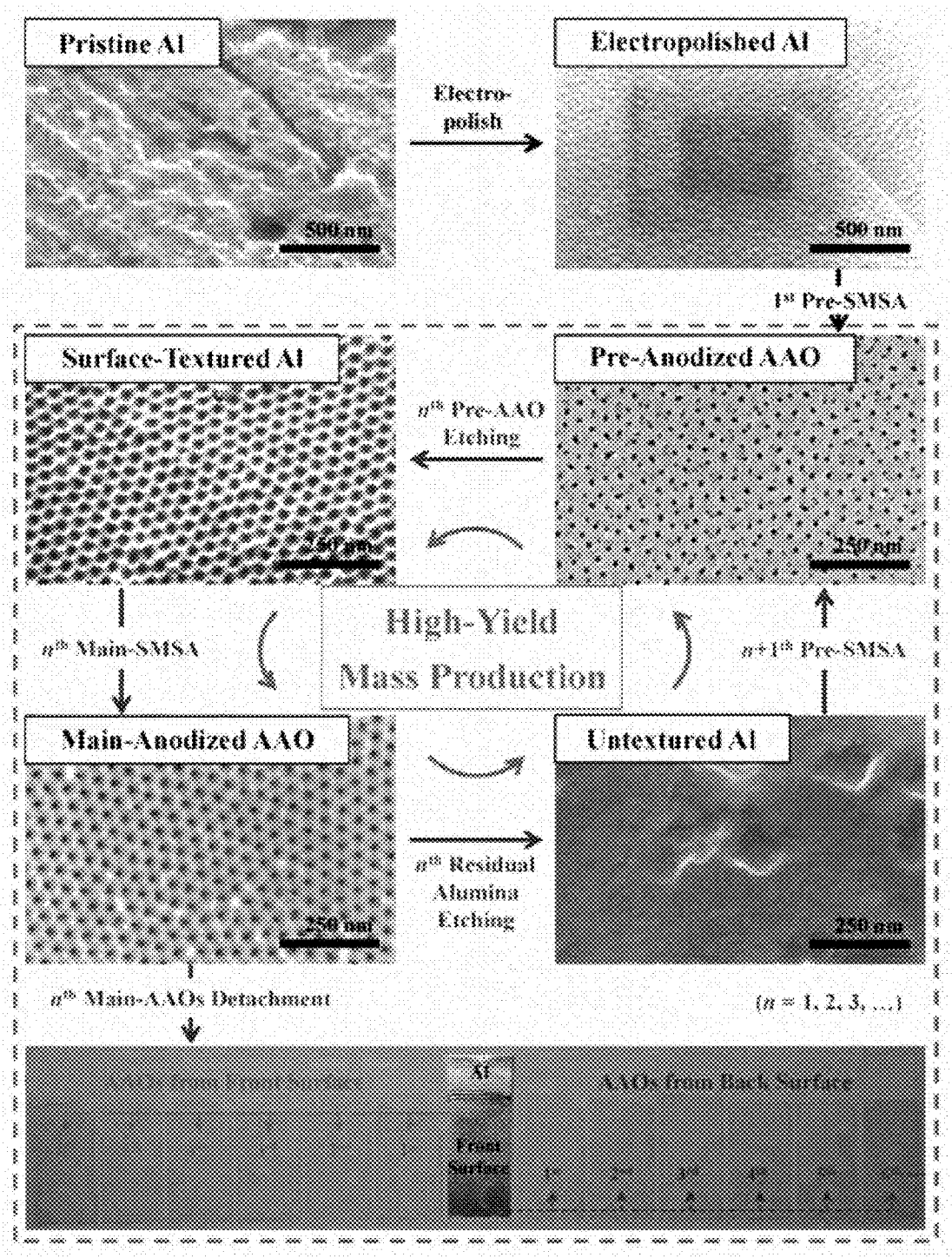
FIG. 9 shows photographic flow chart of the entire AAO manufacturing procedures.

FIG. 9 shows a photographic flow chart of the entire AAOs manufacturing procedures using an aluminum specimen.

Nanoporous AAO templates (i.e., main-AAOs) may keep manufacturing without waste of aluminum by sequentially repeating the procedures, described in FIG. 9. The aluminum specimen can re-texture through the pre-anodizing step S3000, the main-etching step S4000, fabrication of main-AAOs through the main-anodizing step S5000, applying a reverse bias to detach the main-AAOs from the aluminum specimen, and removing residual oxide layers from the aluminum specimen through the sub-etching step.

Pristine aluminum specimen may be electro-polished. The surfaces of the aluminum specimen may be textured through an nth pre-anodizing step (n=1, 2, 3 . . . ) and an nth main-etching step. Next, $n^{th}$ main-AAOs may be formed through an $n^{th}$ main-anodizing step. If there is a remaining aluminum, an $n^{th}$ main-etching step for removing residual oxide layers may be performed to obtain a untextured aluminum specimen, and an $[n+1]^{th}$ pre-anodizing step may be executed. Sequentially, $[n+1]^{th}$ main-AAOs may be detached from the aluminum specimen by applying a reverse bias thereto. A dashed box in FIG. 9 represents a unit sequence in mass-production of nanoporous AAOs.

FIG. 10 shows SEM images nanoporous AAO templates, which were fabricated through six times repetitions of above described procedures with one aluminum specimen.

Figure 10A:
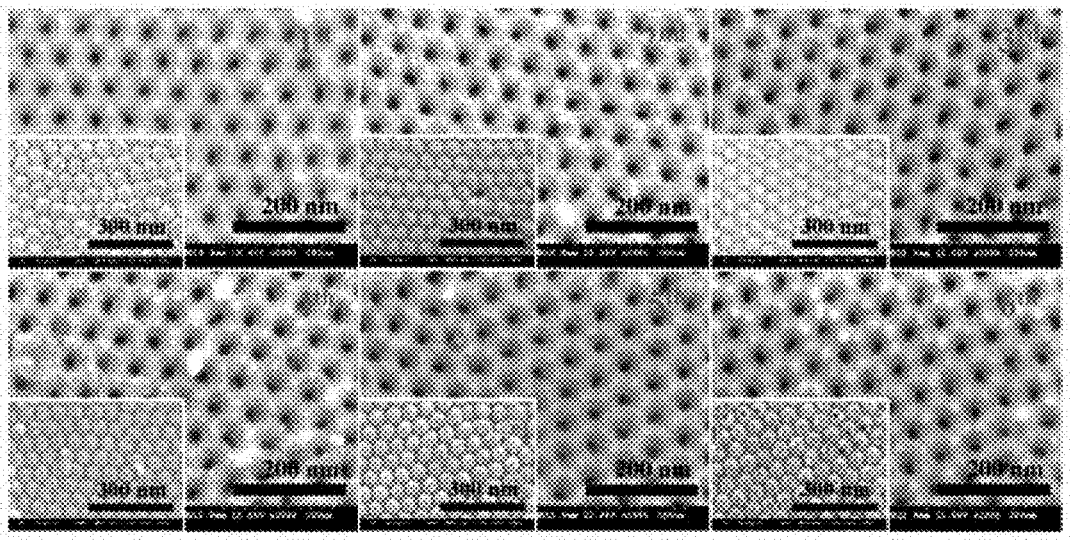
FIGS. 10A and 10B show scanning electron microscope (SEM) images of the open-pore sides of nanoporous AAOs obtained from (FIG. 10A) front and (FIG. 10B) back surface on the same aluminum specimen, by six times sequentially repeating procedure (described in FIG. 9) on one aluminum specimen. Insets: SEM images of the barrier sides on the corresponding samples.
Figure 10B:
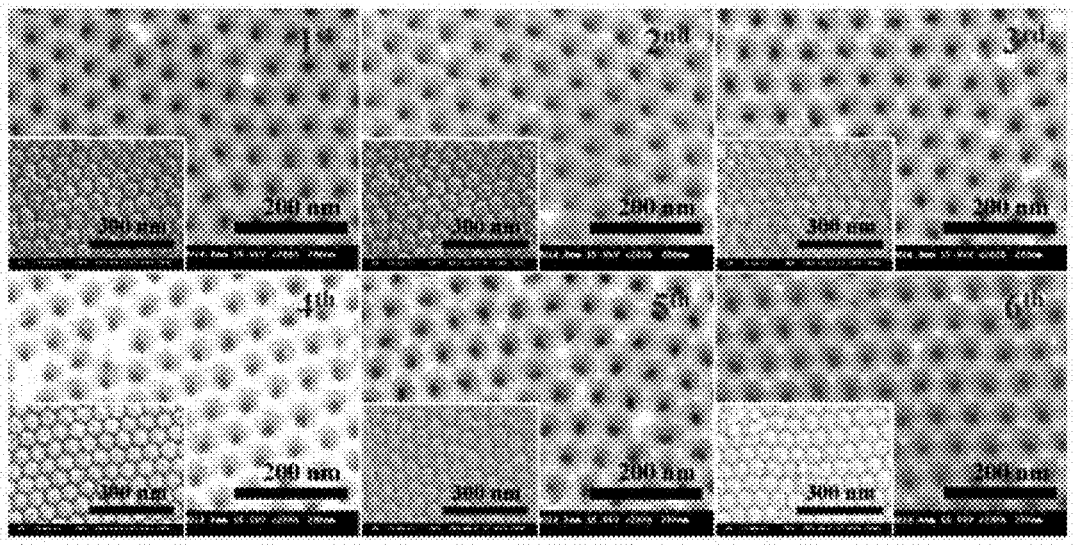

FIG. 10A shows nanoporous templates generated at the front surface of the aluminum specimen, and FIG. 10B shows those from the back surface.

As a result of six times repetition of manufacturing procedure according to embodiments of the inventive concept for producing high-efficiency and eco-friendly nanoporous templates, it may be seen that diameters of nanopores, interpore distances, and thicknesses of nanoporous AAO templates generated through each sequence are almost identical each other. This result indicates that unit sequence consisting of simultaneous multi-surfaces anodization and direct detachment by stair-like reverse bias to multiple surfaces of the specimen is independent to every repetition.

According to a method for manufacturing anodic metal-oxide nanoporous templates according to embodiments of the inventive concept, since several metal surfaces are simultaneously anodized, it may be allowable to significantly improve the efficiency of manufacturing nanoporous anodic oxide layers even with MA-based 2-step anodization.

According to a method for manufacturing anodic metal-oxide nanoporous templates according to embodiments of the inventive concept, it can be possible to minimize harmfulness to human bodies and environments different from the prior art.

Additionally, since an anodic metal-oxide nanoporous template is detached without dissolving metal specimen, it may be allowable to greatly reduce a processing time. And recyclability of a remaining metal is useful for efficiently utilizing resources.

While the inventive concept has been described with reference to exemplary embodiments, it will be apparent to those skilled in the art that various changes and modifications may be made without departing from the spirit and scope of the inventive concept. Therefore, it should be understood that the above embodiments are not limiting, but illustrative.

What is claimed is:

1. A method for manufacturing anodic metal-oxide nanoporous templates, the method comprising:

simultaneously anodizing multiple surfaces of a metal specimen to form nanoporous anodic oxide layer on each surface by applying forward bias to the metal specimen; and simultaneously detaching the nanoporous anodic oxide layers from the metal specimen, wherein the detaching of the nanoporous anodic oxide layers from the metal specimen comprises applying a stair-like reverse bias to the metal specimen;

wherein the anodizing and detaching steps are performed in the same acidic electrolyte; and wherein, when the forward bias is +25 V, the stair-like reverse bias is applied in three stairs of −15 V, −16 V and −17 V.

2. The method of claim 1, wherein the simultaneous anodizing of the metal specimen comprises:

simultaneously pre-anodizing the metal specimen by dipping more than one surface of the metal specimen in an acidic electrolyte and by applying a forward bias for anodization of the metal specimen;

simultaneously main-etching the metal specimen to remove more than one of the pre-anodized oxide layers that are generated by the pre-anodizing; and simultaneously main-anodizing the metal specimen to form main-anodized oxide layers by dipping in an acidic electrolyte more than one surface of the metal specimen, which is textured through the main etching, and by reapplying a forward bias for anodization to the textured metal specimen.

3. The method of claim 2, further comprising, after simultaneously detaching the main-anodized oxide layers from the metal specimen, sub-etching the metal specimen to simultaneously remove remaining residual oxide layers from more than one surface of the metal specimen.

4. The method of claim 3, wherein the simultaneous pre-anodizing, the simultaneous main-etching, the simultaneous main-anodizing, the simultaneous detaching of the main-anodic oxide layer, and the simultaneous sub-etching are repeated at least two or more times.

5. The method of claim 1, further comprising:

before the simultaneous anodizing of the metal specimen, simultaneously electro-polishing more than one surface of the metal specimen.

6. A method for manufacturing anodic metal-oxide nanoporous templates, the method comprising:

providing an aluminum specimen;

simultaneously electro-polishing surfaces of the aluminum specimen in a solution containing perchloric acid and ethanol;

simultaneously pre-anodizing the electro-polished aluminum specimen by dipping the electro-polished metal specimen in a sulfuric acid solution and applying a forward bias for anodization to the electro-polished aluminum specimen;

simultaneously main-etching pre-anodic aluminum oxide (pre-AAO) layers, which are generated by the pre-anodizing, in a chromic acid solution;

simultaneously main-anodizing the aluminum specimen to form main-AAO layers by dipping more than one surface of the aluminum specimen, which is textured through the main etching, in a sulfuric acid solution and reapplying a forward bias for anodization to the textured aluminum specimen; and applying a stair-like reverse bias to the aluminum specimen to simultaneously detach main-AAO layers, which are generated by the main anodizing, from the aluminum specimen;

wherein the anodizing and detaching steps are performed in the same acidic electrolyte; and wherein, when the forward bias is +25 V, the stair-like reverse bias is applied in three stairs of −15 V, −16 V and −17 V.

7. The method of claim 6, further comprising:

after applying the reverse bias to the aluminum specimen, sub-etching the aluminum specimen to simultaneously remove remaining residual oxide layers from more than one surface of the metal specimen.

8. The method of claim 7, wherein the steps from pre-anodizing through sub-etching are repeated at least two or more times.

9. The method of claim 1, wherein −15 V is applied for 600 seconds, and −16 V is applied for 500 seconds.

10. The method of claim 6, wherein −15 V is applied for 600 seconds, and −16 V is applied for 500 seconds.

* * * * *